US009371592B2

(12) United States Patent
James

(10) Patent No.: US 9,371,592 B2
(45) Date of Patent: Jun. 21, 2016

(54) METHOD FOR ELECTROCHEMICAL MODIFICATION OF LIQUID STREAM CHARACTERISTICS

(71) Applicant: Patrick I. James, Madison, WI (US)

(72) Inventor: Patrick I. James, Madison, WI (US)

(73) Assignee: Blue Planet Strategies, L.L.C., Madison, WI (US)

( * ) Notice: Subject to any disclaimer, the term of this patent is extended or adjusted under 35 U.S.C. 154(b) by 0 days.

(21) Appl. No.: 14/737,827

(22) Filed: Jun. 12, 2015

(65) Prior Publication Data

US 2015/0361570 A1 Dec. 17, 2015

Related U.S. Application Data

(60) Provisional application No. 62/011,838, filed on Jun. 13, 2014.

(51) Int. Cl.

| | |
|---|---|
| ***C25B 1/00*** | (2006.01) |
| ***C25C 1/00*** | (2006.01) |
| ***C25B 1/21*** | (2006.01) |
| ***C25B 9/16*** | (2006.01) |

(52) U.S. Cl.

CPC ... *C25C 1/00* (2013.01); *C25B 1/00* (2013.01); *C25B 1/21* (2013.01); *C25B 9/168* (2013.01)

(58) Field of Classification Search

CPC ..... C25C 1/00; C25B 1/00; C25B 1/21; C25B 9/168

See application file for complete search history.

(56) References Cited

U.S. PATENT DOCUMENTS 9,011,669 B2 * 4/2015 James ..... C02F 1/4693 205/748

* cited by examiner

*Primary Examiner* — Arun S Phasge

(74) *Attorney, Agent, or Firm* — Miodrag Cekic; Intellectual Property Strategists, LLC

(57) ABSTRACT

A method for extraction of target components from raw liquid streams includes steps of providing at least one electrochemical cell arranged to support redox reactions resulting in electrochemical change of oxidation states and concentration of at least one ionized target component, and to control at least one pH value of at least one electrolyte in the at least one electrochemical cell; introducing a raw liquid stream comprising a combination of constituent ionic species into the at least one electrochemical cell; operating the at least one electrochemical cell to change concentrations of at least two oxidation states of at least one targeted ionic species from the constituent ionic species; operating the at least one electrochemical cell to maintain a predetermined range of pH of the at least one electrolyte and to eliminate at least one target component pertinent to the at least one oxidation state of the targeted ionic species.

16 Claims, 7 Drawing Sheets

PRIOR ART

Electrochemical Neutralization Treatment Process

METHOD FOR ELECTROCHEMICAL MODIFICATION OF LIQUID STREAM CHARACTERISTICS

CROSS REFERENCE TO RELATED APPLICATIONS

This application is based upon and claims benefits of Provisional Application No. 62/011,838, entitled "METHOD FOR ELECTROCHEMICAL MODIFICATION OF SELECTED LIQUID STREAM CHARACTERISTICS", filed Jun. 13, 2014. The current application is also related to co-owned U.S. patent application Ser. No. 13/926,291, entitled "APPARATUS AND METHOD FOR ADVANCED ELECTROCHEMICAL MODIFICATION OF LIQUIDS"; Ser. No. 13/621,349, entitled "APPARATUS AND METHOD FOR ELECTROCHEMICAL MODIFICATION OF LIQUIDS" (resulting in the U.S. Pat. No. 9,011,669); Ser. No. 13/117,769, entitled "APPARATUS AND METHOD FOR ELECTROCHEMICAL MODIFICATION OF CONCENTRATIONS OF LIQUID STREAMS" (resulting in the U.S. Pat. No. 8,545,692); Ser. No. 13/251,646, entitled "APPARATUS FOR ELECTROCHEMICAL MODIFICATION OF LIQUID STREAMS" (resulting in the U.S. Pat. No. 8,409,408); Ser. No. 13/020,447 entitled "A METHOD FOR ELECTROCHEMICAL MODIFICATION OF LIQUID STREAMS" (resulting in the U.S. Pat. No. 8,262,892); and Ser. No. 11/623,658 entitled "APPARATUS AND METHOD FOR ELECTROCHEMICAL MODIFICATION OF LIQUID STREAMS" (resulting in the U.S. Pat. No. 7,967,967); all of the above (the applications and the resulting patents) are incorporated herein by reference in respective entireties.

FIELD OF THE INVENTION

The invention relates to a method for improved electrochemical modification of concentrations of constituents of liquid streams which contain organic and/or inorganic impurities. More particularly, the current invention pertains to methods of application of split compartment electrochemical cells to drive targeted redox reactions to treat process liquid streams to directly control their chemistry and to separate and/or convert constituents (contaminants, solvent, or dissolved additives like oxygen) into useful byproducts via the treatment.

BACKGROUND OF THE INVENTION

Contamination of liquid streams with various organic and inorganic pollutants is a serious global environmental problem affecting environment quality and represents significant threat to human health and safety. Substantial metal contamination of aquatic environments may arise from current or past commercial mining and metal extraction processes, surfaces modification and protection processes, or communal and industrial waste sites resulting from a variety of active or defunct industrial fabrication and manufacturing activities. Similarly, significant organic water pollutants, like aliphatic, aromatic, or halogenated hydrocarbons and phenols are frequently associated with oil exploration, extraction and refining, chemicals production, manufacturing processes, or large-scale farming and food processing.

In addition to potential for significant environmental damage, polluted liquid streams represent dilute sources of desirable raw materials like heavy metals and metal oxides. For example, the Berkeley Mine Pit in Butte, Mont. alone represents an estimated 30 billion gallons of acid mine drainage which contains 180 ppm of copper along with other metals and thus could yield up to 22,000 tons of pure copper by use of a small treatment facility.

An economically relevant group of prior art methods of removal of heavy metal ions from liquid solutions is based on chemical precipitation. This process is generally burdened by complexity, high cost, clear preference for extremely large facilities and high-volume operations. Lime neutralization may be regarded as a dominant treatment approach. In general, several embodiments of this approach may yield byproducts including precipitated sludge which may become a concentrated yet mixed contaminant source of the toxins in the source material. The sludge mandates further processing and costly long term disposal as a hazardous waste. Many similar disadvantages burden alternative heavy ion removal methods that may incorporate: filtration, ion exchange, foam generation and separation, reverse osmosis, or combinations of listed processes.

Considerable market research conducted by many strategic metal mining and extraction industry consultants indicates that high grade ore reserves are becoming exhausted, leading world-wide to generally downward trending ore quality. For example, practitioners may need a way to use their existing recovery equipment and processes to recover metals from their often plentiful but presently unusable low-grade ore or tailings from legacy operations. Currently, mines may not be capable to economically process metals when ore sources and/or the resultant process streams containing the target metal extracted from these ores are too weak and need strengthening (concentrating) to allow practical conventional target metal extraction. Thus, the economic considerations may be closely coupled with technology limitations providing for continuous motivation to improve all aspects of the extraction process as measured by cost (capital and operational) reduction metrics.

The extraction technologies enabled by several aspects of the current invention may be adapted to address at least some of the above considerations. In general, metal extraction methods based on redox reactions frequently require acidity control and pH manipulation (such as lowering pH to refresh acid for processing streams, raising pH to improve processing and/or controllably (and selectively) drop out contaminants (metals) as valuable products (hydroxides or other pH sensitive precipitates), or (potentially in conjunction with pH adjust via counter reaction)—manipulate target species redox states to improve selected aspects of the target stream processing. Classic examples may incorporate but are not limited to conversions of $Fe^{+3}$ to $Fe^{+2}$, $Fe^{+2}$ to $Fe^{+3}$, or $Cu^{+1}$ to $Cu^{+2}$ and $Cu^{+2}$ to $Cu^{+1}$.

In particular, technologies for capture of mined metals (e.g. copper processing) from streams frequently include modification of mining streams (raffinate, wastewater, draindown, processing bleeds, Pregnant Leach Solution (PLS), and other stream's chemistry to improve mining productivity. The invention here affords a new ability to effect and control such modifications electrochemically to improve processing efficiency and/or operations.

Mining influenced waters like Acid Rock Drainage (ARD) and acid or alkaline leachates (essentially a naturally occurring leach solution, typically considered wastewater) is often acidic or alkaline and may contain multiple metals in a high sulfate background. ARD could also be economically treated using electrochemical methods of the current invention while achieving new control and selectivity over solids generation during treatment.

Even more particularly, the new method could be employed to perform or mitigate a number of economically relevant treatments traditionally accomplished by chemical additions or needs. Nonexclusive examples include increases of acidity (lower pH) and/or increase of $Fe^{+3}$ concentrations (e.g. for sulfide leaching) which may enhance leaching processes. Similarly, one may lower acidity (raise pH) to enhance solvent extraction efficiency or neutralize streams with potential selective metal (hydroxide) recovery, or one could lower $Fe^{+3}$ content (e.g. converting it to $Fe^{+2}$), to increase the pH of solids formation (precipitation) (e.g. to avoid scale formation/fouling and/or allow selective removal), and effect selectivity/efficiency of other processes like solvent extraction or ion exchange.

Even further, various methods of the electrochemical pH adjustment may be utilized in embodiments concerning control of microbial (viral, bacterial, fungal, protozoal, and macromolecular including misfolded proteins and other malformed molecules, prions and fungal prions) infestations. Usage of acidic or alkaline conditions for control, destruction, sterilization, and or inactivation of microbiological agents has been well understood by practitioners. In particular embodiments of the current inventions, electrochemically generated acidic or alkaline ions may be used to facilitate effectiveness of added or in-situ generated biocides and bio-suppressors in addition to being biocidal or bio-suppressive by itself.

Generally, electrochemical apparatus and methods in accordance to the current inventions utilize electricity as convenient, easily-transportable, and efficiently-controllable "universal electrochemical agent" used in the desirable electrochemical reactions (in addition to conventional usage of electricity only as energy supply). Furthermore, in contrast to standard precipitation and pH control processes requiring deliveries of significant amounts of acids, alkalis, and/or salts (e.g. lime or caustic treatments) various embodiments of the current inventions enable reduction of disposable byproducts (e.g. by in-situ recycling and regeneration of desirable components), and flexibility of process optimization achievable, for example, by active real time (continuous or batch-to-batch) controlling of concentrations, flows, efficiencies, and reaction rates of redox reactions in the targeted electrochemical cells.

SUMMARY OF THE INVENTION

Current invention relates to a method for extraction of target components from raw liquid streams using electrochemical cells by manipulation of solvability, concentrations, and oxidation states of constituents of liquid streams by electro-effecting controllable changes of electrolytes pH values. The method of current invention incorporates steps of: a) providing at least one electrochemical cell arranged to support redox reactions resulting in electrochemical change of oxidation states and concentration of at least one ionized target component, and to control at least one pH value of at least one electrolyte in the at least one electrochemical cell; b) introducing at least one raw liquid stream comprising a combination of constituent ionic species into the at least one electrochemical cell; c) operating the at least one electrochemical cell to change concentrations of at least two oxidation states of at least one targeted ionic species from the constituent ionic species, and to controllably change the pH value of the at least one electrolyte in the at least one electrochemical cell; d) operating the at least one electrochemical cell to maintain a predetermined range of pH of the at least one electrolyte and to aggregate at least a portion of at least one target component pertinent to the at least one oxidation state of the targeted ionic species; e) separating and removing at least the aggregated portion of the at least one target component pertinent to the at least one oxidation state of the targeted ionic species; and f) separating and extracting at least a part of reacted products from the at least one electrolyte in the at least one electrochemical cell.

An apparatus in accordance with the current invention may include at least one electrolytic cell having at least one electrode compartment structured to contain a liquid electrolyte. The at least one electrolytic cell is structured to support redox reactions and to generate liquids usable for creating and maintaining particular concentrations of selected targeted ions such as Hydrogen ions conducive for applications such as the precipitation of targeted materials in internal or separate reactors.

BRIEF DESCRIPTION OF THE DRAWINGS

The above and other embodiments, features, and aspects of the present invention are considered in more detail in relation to the following description of embodiments shown in the accompanying drawings, in which.

DETAILED DESCRIPTION OF THE INVENTION

The invention summarized above may be better understood by referring to the following description, which should be read in conjunction with the accompanying drawings. This description of an embodiment, set out below to enable one to build and use an implementation of the invention, is not intended to limit the invention, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
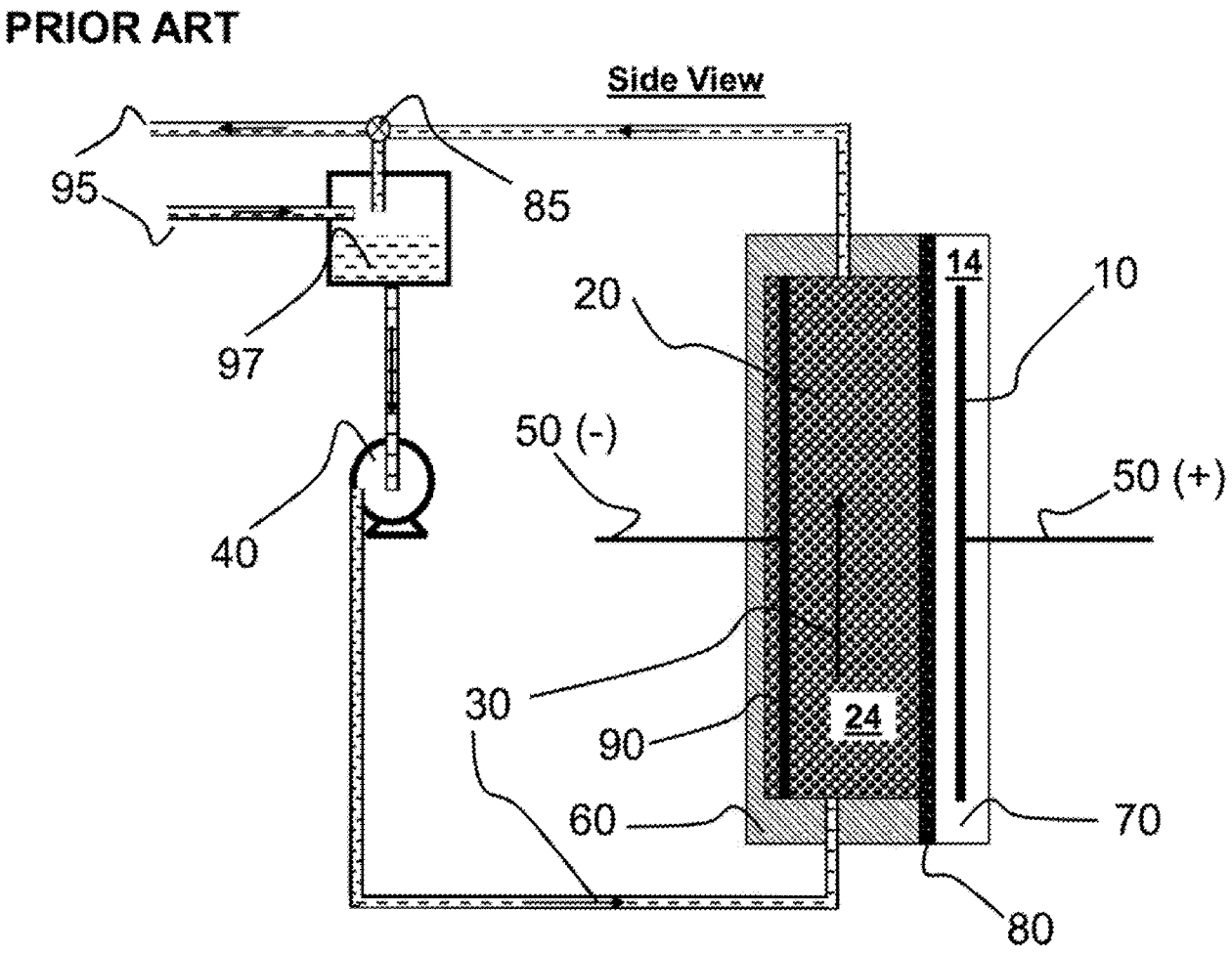
FIG. 1 is a schematic cross-sectional side view of devices in accordance with prior art.

It may be generally recognized that operation of electrochemical cells is based on redox reactions and can employ cells which can occur in many forms. In general, the class of split compartment cells (SCC) (in their multitude of forms) can provide examples of suitable apparatus to accomplish the current method disclosed herein. One such relevant example typical of the class of Moving Bed Electrode (MBE) cells may be represented by the specific example from the subset of Spouted Bed Electrode (SBE) cells as disclosed in the above incorporated (by the reference in the opening paragraph) U.S. Pat. No. 7,967,967 and schematically illustrated in the FIG. 1. The one embodiment of an SBE cell of prior art provides a single, but nonexclusive example of a device suitable for use in the current method for illustrative purposes and may include of one or more anodes 10 coupled to one or more high surface area cathodes 20, here in the form of a spouted moving particulates bed, separated by a distance. Catholyte flow 30 of liquid electrolyte catholyte 24, driven by an external catholyte pumping station 40, is directed through the high surface cathode 20 to achieve vigorous convection in the particulates bed to facilitate a high degree of electrode utilization. Unidirectional current is fed into the cell via anode current feed 50(+) and out via cathode current feeder device 90 and cathode current feed 50(−). The cell illustrated in the FIG. 1. is shown in a simple double chamber planar configuration comprising cathode cell chamber 60 and anode cell chamber 70 (generally containing electrolytes, catholyte 24 and anolyte 14 respectively) each pair of which is separated by a separator allowing ionic conduction (a porous or selective membrane for example) 80 which directs the bulk flows of electrolytes (catholyte 24 and anolyte 14) while maintaining intimate electrochemical contact between the separated cathode 20 and anode 10 via ionic conduction. The authors note that other cell configurations (stacked, cylindrical, etc.) could readily also be employed and that cells employing multiple and additional chambers may be of the same or different configurations and employ the same or different cathodes 20, anodes 10, and separators 80 as desired by a specific situation. Depending upon the state of control valve system 85 the cell can operate in a batch mode processing the fluid contained in the reservoir 97, or in a flow-through mode modifying liquid streams delivered by external pipelines 95.

Figure 2:
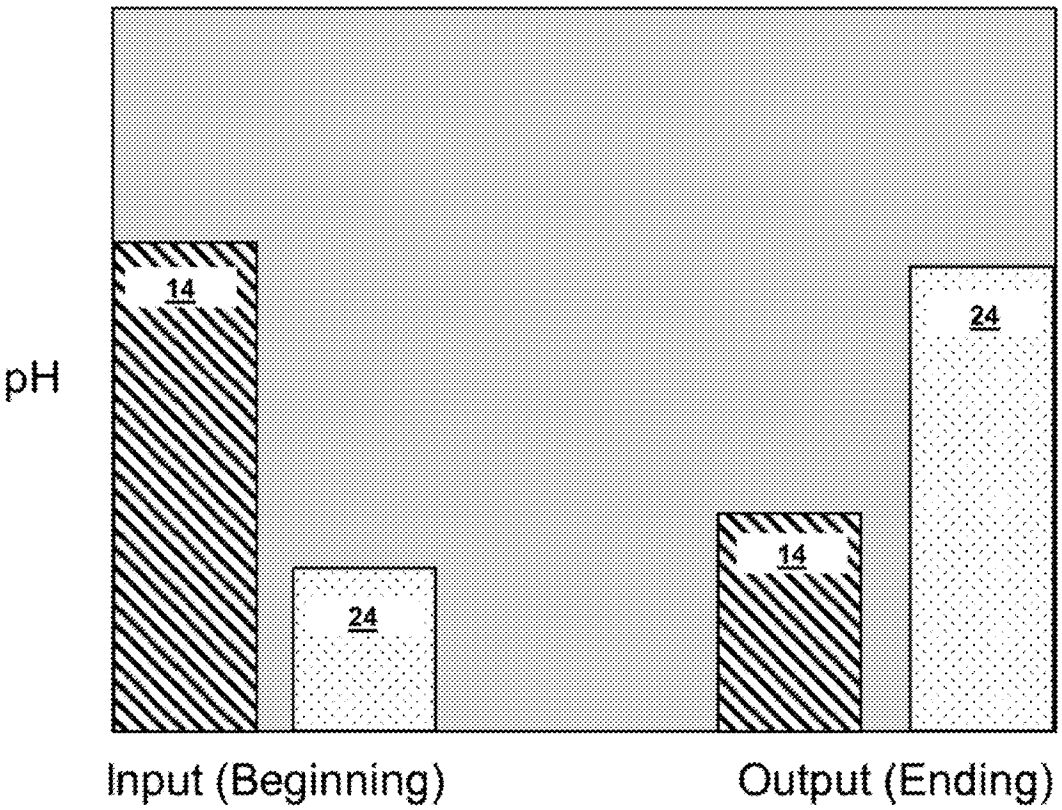
FIG. 2 is a graphic illustration of particular features in accordance with prior art.

It is well-understood that the operation of a SCC cell may be based in redox chemical reactions generally resulting in changes of pH values of the anolyte 14 from relatively high input (beginning value in the batch operation embodiments) value to relatively lower output value (ending value in the batch operation embodiments), while in opposition, the catholyte 24 may be reacted from respective states of relatively low pH into states of relatively high pH values. It may be noted that such acidity changes may be controlled by the specific design and components of the apparatus, control of the fluid flows and electrical discharge parameters. It may be additionally noted that, by arranging and controlling of transport (motions and reactions) of charged species (e.g. ions and electrons) through any simple or composite (multi-chamber) cell one can change oxidation states and/or pH of the electrolytes (and other compounds) in the pertinent chambers of the particular electrolytic cell. Thus, in the simple example in FIG. 2, one may note that the electrochemical redox process generally increase acidity (reduce pH) of the anolyte 14, while simultaneously increasing alkalinity (increasing pH) of the catholyte 24.

For example, at the cathode 20 the pH might be raised by proton reduction and hydrogen formation (typical—water splitting at elevated pH or acid neutralization at low pH Eqs. (1)-(3)). Alternatively, oxygen reduction might be targeted to generate alkaline hydroxide or even a potential reactant like hydrogen peroxide (which can then be used as an oxidant or a reductant depending on the detailed chemistry created).

| | CONDITIONS |
|---|---|
| $2H^+ + 2e^- \rightarrow H_2(g)$ | (1) ACID |
| $H^+ + H_2O + 2e^- \rightarrow H_2(g) + OH^-$ | (2) Neutral/Alkaline |
| $O_2 + 2H_2O + 4e^- \rightarrow 4OH^-$ | (3) Neutral/Alkaline |

The devices and methods of several embodiments of the current invention may be understood using the above concepts of electrochemical controlling of the acidity of pertinent electrolytes and the oxidation states of selected constituents for treatment of preexisting liquid media and/or ad hoc prepared solutions using electricity. More particularly, in some embodiments one or more electrochemical cells may be used singularly or in combinations to separately, simultaneously, or combinations thereof, control pH values of the electrolytes, generate particular oxidation states of the constituents, and act as a reactor for targeted chemical reactions (e.g. precipitation of particular metal hydroxides).

Figure 3:
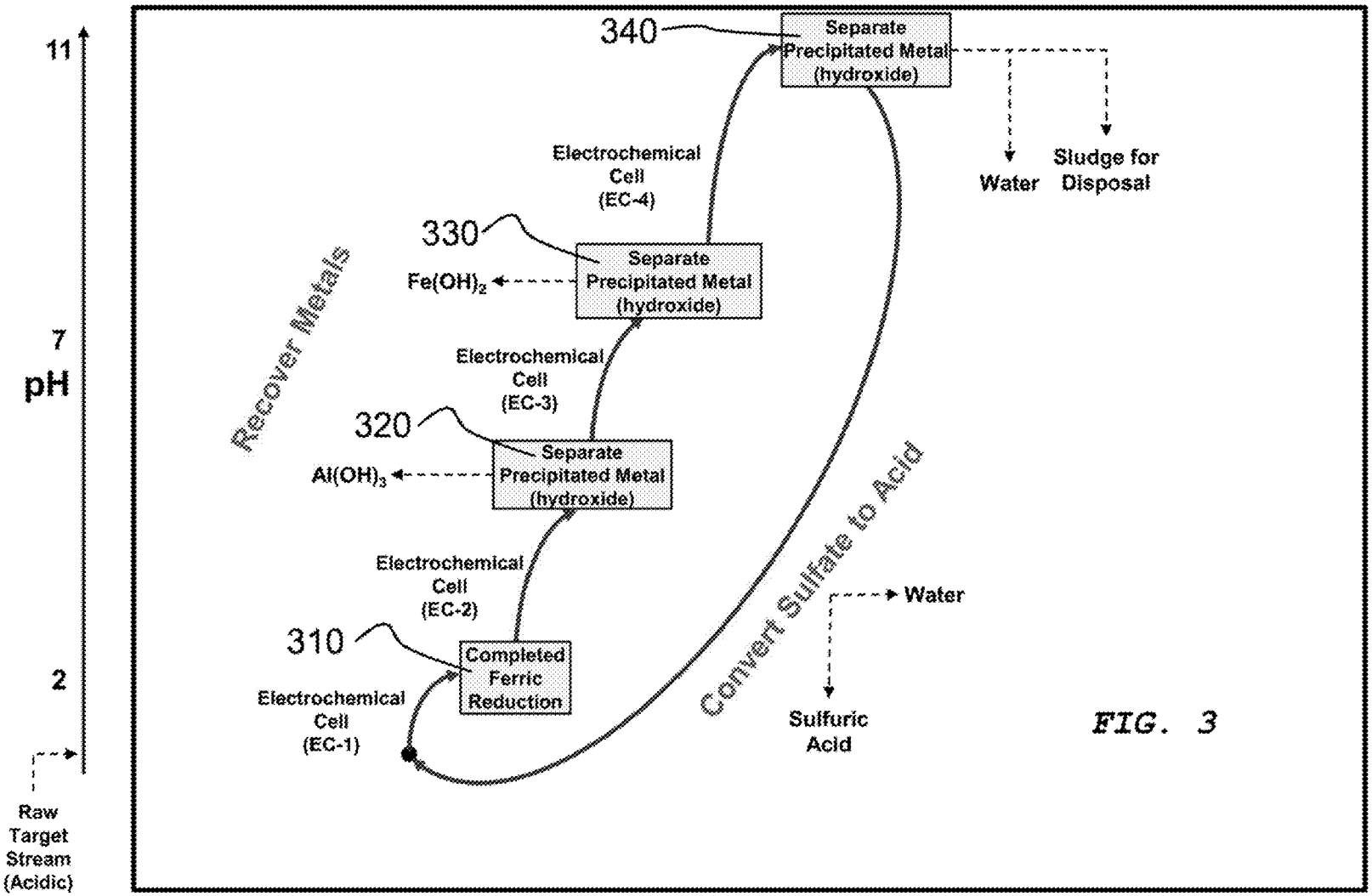
FIG. 3 is a schematic illustration in accordance with one embodiment of the current invention.

One exemplary application concerning methods of electrochemical treatment of ARDs incorporating concentrations of aluminum ions and various oxidation states of Fe ions is given schematically in FIG. 3. The illustrated example includes raising the pH of an incoming typical raw target ARD stream (acidic, pH ~1 and containing a combinations of metals including ferric ion ($Fe^{+3}$) and aluminum ($Al^{+3}$)) in a controlled and staged fashion to enable enhanced and selective metal recovery via hydroxide driven sequential precipitation of the target metals. It also notes the concurrent acid generation in the anolyte as a potentially useful byproduct of the targeted reduction reactions in the catholyte. At each electrode single or multiple reactions can be targeted to be driven either essentially sequentially or simultaneously within one or more of the electrochemical cells or cell chambers within a given cell. For example, initial reduction of the catholyte ferric ($Fe^{+3}$) to ferrous ($Fe^{+2}$) (with concurrent anolyte acid generation) as an alternative and additional reaction to the catholyte proton elimination at the cathode is noted as a specific embodiment of the disclosed method.

FIG. 3 illustrates the application and utility of the disclosed method for the specific exemplary embodiments, not exclusive of other applications, of treatment of ARD's by electrochemical tailoring the oxidation state of selected contaminants and also the overall solution pH. Depending upon particulars of different embodiments several different metal ions and ionization states including (but not limited to) Aluminum $Al^{+3}$, Cobalt $Co^{+2}$, Cobalt $Co^{+3}$, Cuprous $Cu^{+1}$, Cupric $Cu^{+2}$, Ferrous $Fe^{+2}$, Ferric $Fe^{+3}$, Magnesium $Mg^{+2}$, Manganese $Mn^{+2}$, Nickel $Ni^{+2}$, Nickel $Ni^{+3}$, Zinc $Zn^{+}$, and Zinc $Zn^{+2}$ may be present.

The initial step 310 of FIG. 3 includes introduction of raw target stream (here acidic ARD) into the cathode chamber of electrochemical cell EC-1 arranged here for catholyte ferric reduction in preference to catholyte proton reduction. The separated chamber nature general to split compartment cells, (recall the general class of applicable electrochemical cells noted in paragraph [0022]) such as the specific SBE version used here for illustration, may limit significantly bulk electrolyte mixing. This may minimize parasitic counter reaction losses (i.e. neutralization of anode generated protons by cathode proton consumption and by reacting with cathode generated hydroxide or similarly anode oxidation of cathode generated catholyte ferrous ($Fe^{+2}$) and anode regeneration of ferric ($Fe^{+3}$). Removal of ferric ($Fe^{+3}$) in step 310 reduces the possibility of ferric oxyhydroxides like ferric hydroxide ($Fe(OH)_3$) precipitation at pH ~3, thus clearing the way for subsequent metal oxyhydroxide precipitation step 320. Step 320 of precipitation and extraction of other metal oxyhydroxides like $Al(OH)_3$ may be achieved by controlling the pH (for this embodiment to about pH~5) in a reactor using product catholyte from cell EC-2. Subsequently, in Step 330 separate precipitation of $Fe(OH)_2$ may be conducted in a reactor characterized by relatively reduced acidity (e.g. having substantially neutral pH~8) through use of product catholyte from cell EC-3. Following step 340 may include separation of additional metal oxihydroxides from alkaline solutions (e.g. pH ~11) produced using product catholyte from cell EC-4 and outputting of the resulting alkaline liquid products for other uses and/or reusing all or part of it as constituents of electrolyte feedstocks for cells EC-X where X=1 to 4. A non-exclusive reuse example for the neutralized or acidic products may be to chemically leach additional metals out of predisposed materials (natural or man-made deposits of low grade ores or similar).

Figure 4:
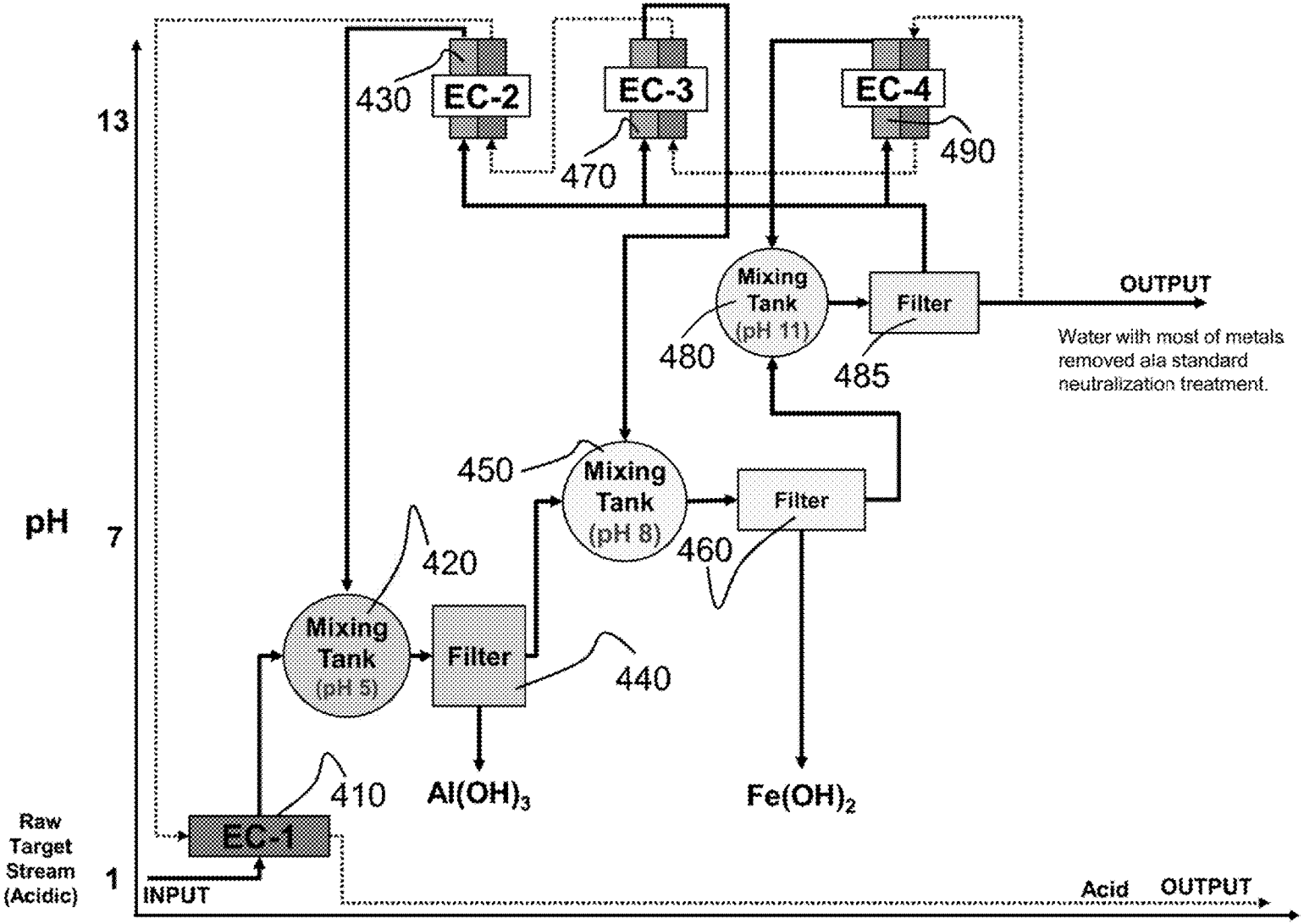
FIG. 4 is a schematic illustration of one embodiment of the current invention.

One embodiment of a processing device in accordance with the above processing scheme has been illustrated in FIG. 4. The device of the illustrated embodiment has been arranged to receive external unprocessed ("raw") liquid stream ("Acidic Raw Target Stream") preferably into the at least one cathode cell chamber 60 of at least one electrochemical cell EC-1 410 for predominantly the reduction of the $Fe^{+3}$ to the $Fe^{+2}$ oxidation state. In particular embodiments, one or more high surface area cathodes 20 in the form of a spouted particulates bed may be utilized at least because of relatively high specific electrode surface area well-suited for efficient contacts to the cathode current feeder device 90 and the catholyte stream 24. In the particular embodiment, the electrochemical cell EC-1 410 may be arranged to diminish collection of the products of the redox reactions on the electrode surfaces ("electrode plating") in at least to facilitate stability and uniformity of the cell operations.

The resulting catholyte processed by the cell EC-1 410 may be transferred into at least one separate first mixing tank 420 for precipitation of $Al(OH)_3$, $Al(OH)(SO_4)$, or analogs at the pH~5. The desired moderate acidity (pH~5) conducive to essentially complete precipitation of the $Al(OH)_3$ analog compounds (analogs) may be created and maintained using resulting catholyte from the cell EC-1 410 potentially mixed with the higher pH catholyte from another electrochemical cell EC-2 430. In the particular embodiment, the electrochemical cell EC-1 410 may also be arranged for the efficient conversion of other reducible species than protons (such as $Fe^{+3}$ to $Fe^{+2}$ here), while the electrochemical cell EC-2 430 may be arranged for generation of higher pH catholyte sufficient to maintain substantially stable pH (e.g. pH~5) in the first mixing tank 420. The precipitated $Al(OH)_3$ and/or analog compounds may be separated and removed by various means, for example, by filtration in first filtering unit 440. It may be noted that, at least for the purpose of the current application, the analog compounds (analogs) have been defined as all forms and mixtures of related inorganic and organic compounds including but not limited to simple and complex inorganic or organic hydroxides and associated salt; hydrated hydroxides and salts incorporating one or more water molecules; monomers, dimmers, oligomers, and polymers incorporating hydroxides or salts; coordination complexes; compounds including polyoxometalates; colloidal and hydrocolloidal aggregates; and mixtures and combinations of above.

Subsequently, filtrate solution from the first filtering unit 440 may be transferred to second mixing tank 450 for subsequent precipitation of other components (here noted as $Fe(OH)_2$ at the pH~8). The desired acidity (pH~8) conducive to precipitation of the $Fe(OH)_2$ analog in mixing tank 450 may be created and maintained using resulting higher pH catholyte from another electrochemical cell EC-3 470 arranged for generation of the anolyte having desired concentration of hydroxyl ions and potentially in-mixed with the filtrate solution from filtration unit 440. The ferrous hydroxide $Fe(OH)_2$ analog compound may be in turn separated by filtration in second filtering unit 460.

Similarly as above, the filtrate from the second filtering unit 460 may be transferred to third mixing tank 480, where additional metals may be precipitated, for example at pH~11 such as is typical of conventional mixed ion precipitation used in wastewater treatment, and separated by third filtering unit 485. Additional or less mixing tanks and precipitation stages to further sub-divide the process as desired to fit specific target chemistries could also be readily employed. The desired pH (~11) may be maintained using higher pH catholyte from yet another electrochemical cell EC-4 490, optimized to maintain pH~11 in the mixing tank 480. At such alkalinity, many metal hydroxides and associated compounds may be precipitated (and subsequently removed e.g. by the filtering unit 485) resulting in the substantially metal pollution free filtrate solution containing little residual metals to generate fouling solids in the high pH catholyte circuits of EC-2, EC-3, and EC-4. Accordingly, the filtrate can be used to support the catholytes of the electrochemical cells EC-2 430, EC-3 470 and EC-4 490. Similarly, filtrate solution from the filtering unit 485 may also be utilized to support anolytes in the electrochemical cells 430, 470, and/or 490.

Figure 5:
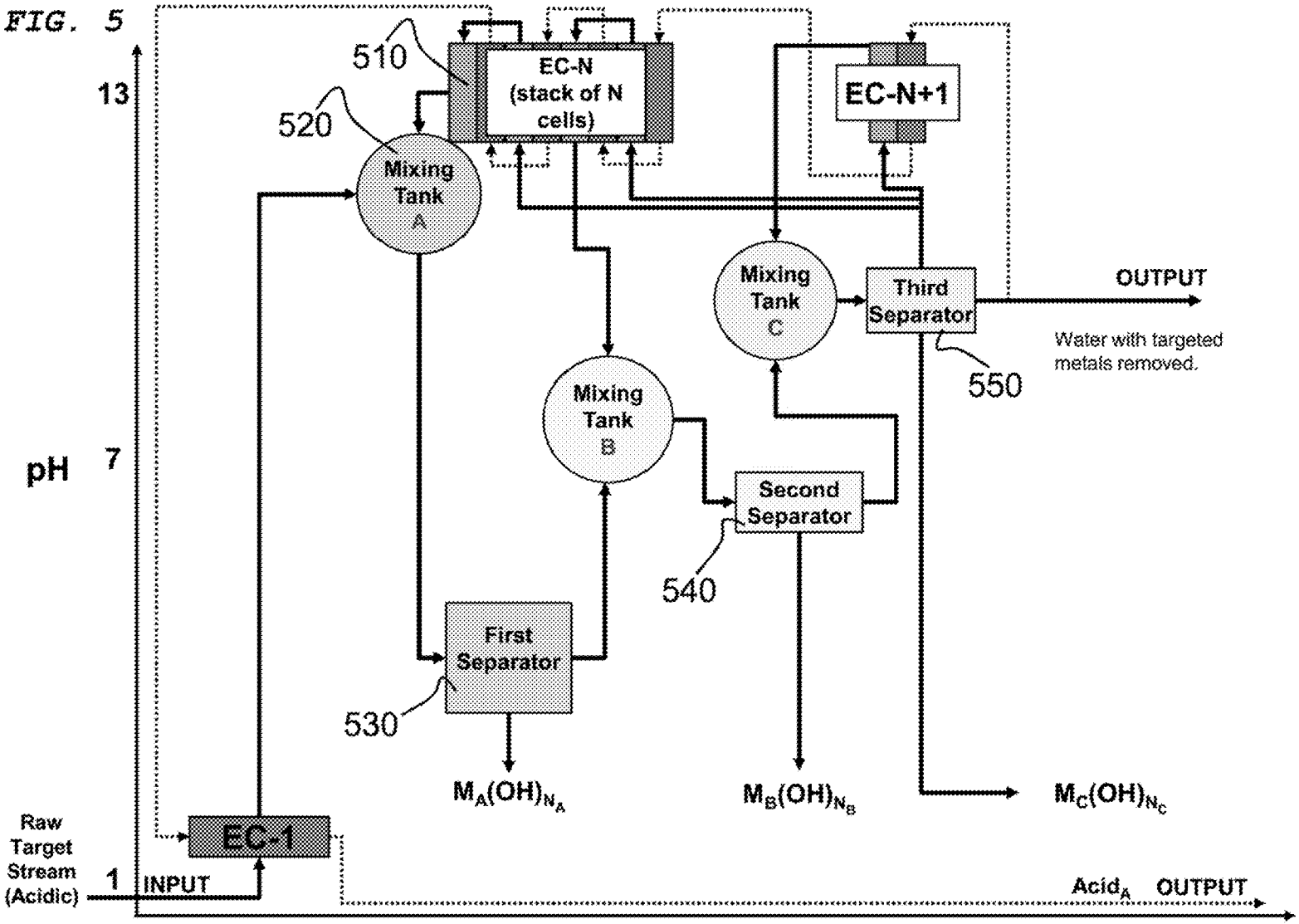
FIG. 5 is another schematic illustration of one embodiment of the current invention.

Another class of embodiments has been schematically illustrated in FIG. 5. In such embodiments, separated electrochemical cells EC-2 430 and EC-3 470 have been replaced by at least one compounded electrochemical cell EC-N 510 including a plurality of chambers. The cell EC-N 510 may be structured to generate a plurality of electrolytes arranged to maintain prearranged pH in more than one mixing tank (e.g. mixing tank A 520 and mixing tank B 530). In the illustrated embodiments, at least one mixing tank (e.g. mixing tank A 520) may be arranged in a proximity to the electrochemical cells. It should be noted that the special proximity may not necessitate the proximity of pH values of the mixing tanks and the electrolytes as the precipitation pH values in the mixing tanks may be influenced by the acidity (alkalinity) of the input and output processing streams. It should be also noted that the mixing tanks in different embodiments may be structured as external or internal subassemblies of the electrochemical cells (e.g. 430 or 510) at least for reduced circulation complexity and losses. Also, cells may incorporate one or more separators (e.g. first, second, or third separator 530-550 separately or in combinations) which may or may not each employ different or the same separating mechanisms. One may note that separators 530-550 may not be limited to filtering units only. Any method (mechanical, hydraulic, electrostatic, electromagnetic, gravitational or combined) may be utilized in different embodiments to separate desired products of reactions in mixing tanks (e.g. metal Mx hydroxides $Mx_i(OH)_j$ and associated analogs).

Figure 6:
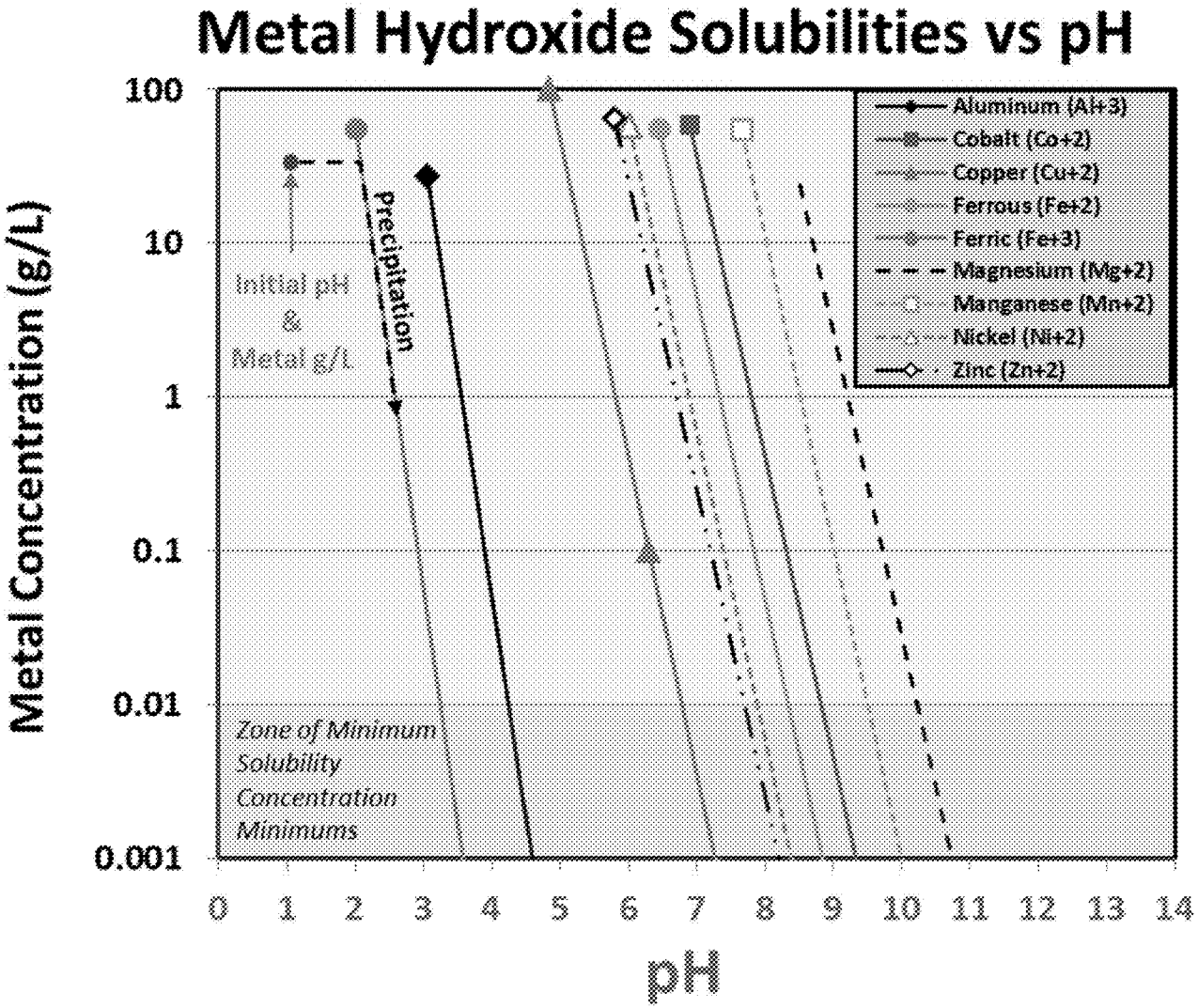
FIG. 6 is a graphic illustration of particular features in accordance with current invention.

The example of precipitation of various different commercially valuable metal hydroxides may be further elaborated on the basis of the idealized representative Metal Hydroxide Solubility vs. pH graphs exemplified in FIG. 6 and summarized in Table 1 (adopted from Chapter 7 of The International Network for Acid Prevention INAP web page starting at: guide.com/index.php?title=Main_Page Jun. 1, 2014).

TABLE 1

| Metal | Raffinate Precipitation pH Range |
|---|---|
| Ferric iron, $Fe^{3+}$ | 2 to 3 |
| Aluminum, $Al^{3+}$ | 3 to 4 |
| Copper, $Cu^{2+}$ | 6 |
| Ferrous iron, $Fe^{2+}$ | 6.5 to 7.5 |
| Zinc, $Zn^{2+}$ | 7 |
| Nickel, $Ni^{2+}$ | 7.5 |
| Cobalt, $Co^{2+}$ | 8.2 |
| Manganese, $Mn^{2+}$ | 8.6 |
| Magnesium, $Mg^{2+}$ | 9 |

As discussed above, the electrochemical cells can be separate (e.g. 430, 470, or 490) or composite (510) and/or arranged to perform single or multiple functions in a single unit. The target contaminant (metals) separation can be effected singly, sequentially, or in conjunction with manipulation of the specific target materials being controlled through the operation of the electrochemical cell and mixing condition details. The separation can be effected solely by the electrochemical cell or in conjunction with additives (e.g. adding ozone at elevated pH to oxidize Mn or other additives to facilitate desired processing or sulfide derivative compounds to achieve pH sensitive metal sulfide precipitation to further refine target product separation). In different embodiments of the present invention, ozone or other desired products comprised of oxidants or reductants may be generated via at least one electrochemical cell (either in-situ, like EC-1 410 or separately but on site as with EC-2 430 and/or EC-N 510. The specific location of production within the cell depends upon whether the product is generated through a reduction or oxidation reaction. It is noted that some compounds (like hydrogen peroxide) may be both oxidizers or reducers depending on specific chemistry details and can be generated at either the anode or cathode depending on how the detailed electrochemistry chemistry is controlled.

In particular embodiments exemplified by the schematics in FIG. 4, the at least one electrochemical cell EC-1 410 may be arranged to perform both pH alteration and another targeted redox reaction (here $Fe^{+3}$ to $Fe^{+2}$) concurrently, whereas the electrochemical cells EC-2 430, EC-3 470, and/or EC-4 490, may be arranged and optimized to perform dominantly pH adjustment and sustainment. Chemically, one of the differences between these electrochemical cell groups may include: the case where the neutralization reaction can occur outside the cell by leveraging the water neutralization reaction (that is, the electrochemical cell product may be in effect a proxy for the actual targeted goal so it can be made in one spot and used in another.) This may be especially significant with a redox reaction involving ozone or peroxide, for example. Another feature may concern the situation wherein the pH reaction may utilize water as a reactant and thus in aqueous solution effectively has a nearly unlimited supply of reactant whereas other redox species one might target are limited, and get depleted in the cell such that other reactions begin to occur. Such feature may provide opportunity to recycle target ions in a fashion improving process practicality. For example, sodium acting as a supporting electrolyte effectively acts as a carrier (charge balance) for generated hydroxide and can be reused since it is not precipitated in the target pH range. Thus, in comparison to costly NaOH (caustic soda) addition, the electrolytic process may allow effective refreshing of the neutralizer where the sodium is recycled through the process and new hydroxide is generated, thereby lowing chemical feedstock input needs and significantly improving process practicality.

A multitude of potential separations/recoveries may be structured as separate embodiments or in combinations. An exemplary subset may include metal hydroxide separations where the target metals can selected through a combination of tailored solution constituent redox state and solution pH conditions generated as a result of the electrochemical treatment. Common representative metal hydroxide examples may be seen in FIG. 6 and Table 1 (e.g. aforementioned separation of $Al^{+3}$ from a mixture of $Fe^{+2}$ and $Fe^{+3}$ via reduction of $Fe^{+3}$ to $Fe^{+2}$). It should be also noted that the process using reduction of $Fe^{+3}$ to $Fe^{+2}$ may be proffered as the direct separation of $Fe^{+3}$ from $Al^{+3}$ may be less practical because of proximity of pertinent pH precipitation ranges (FIG. 6 and Table 1).

In addition, a variety (or mixture) of acids could be generated in different embodiments. Embodiments generating sulfuric acid may be of particular interest since the raw target stream sources including sulfate may be very common. Also, embodiments including seawater application as the raw target stream (which the mining industry may be increasingly utilizing) may generate HCl—should that be of interest. Furthermore, the initial input stream could start at higher, near-neutral, or even alkaline pH with the process reversed—treatment lowers input stream pH to effect targeted separations within the anolyte and the "byproduct" may be now a strong base (catholyte) where $Mx(OH)_N$ could be a variety of Mx and N combinations where $Mx(OH)_N$ may be highly soluble (including alkali metals and ammonium or organics cations). An example and nonexclusive application embodiment would be the treatment of drainage from coal mining sites which is known to occur in many forms with a bimodal pH distribution, sometimes being acidic and other times being alkaline.

Figure 7:
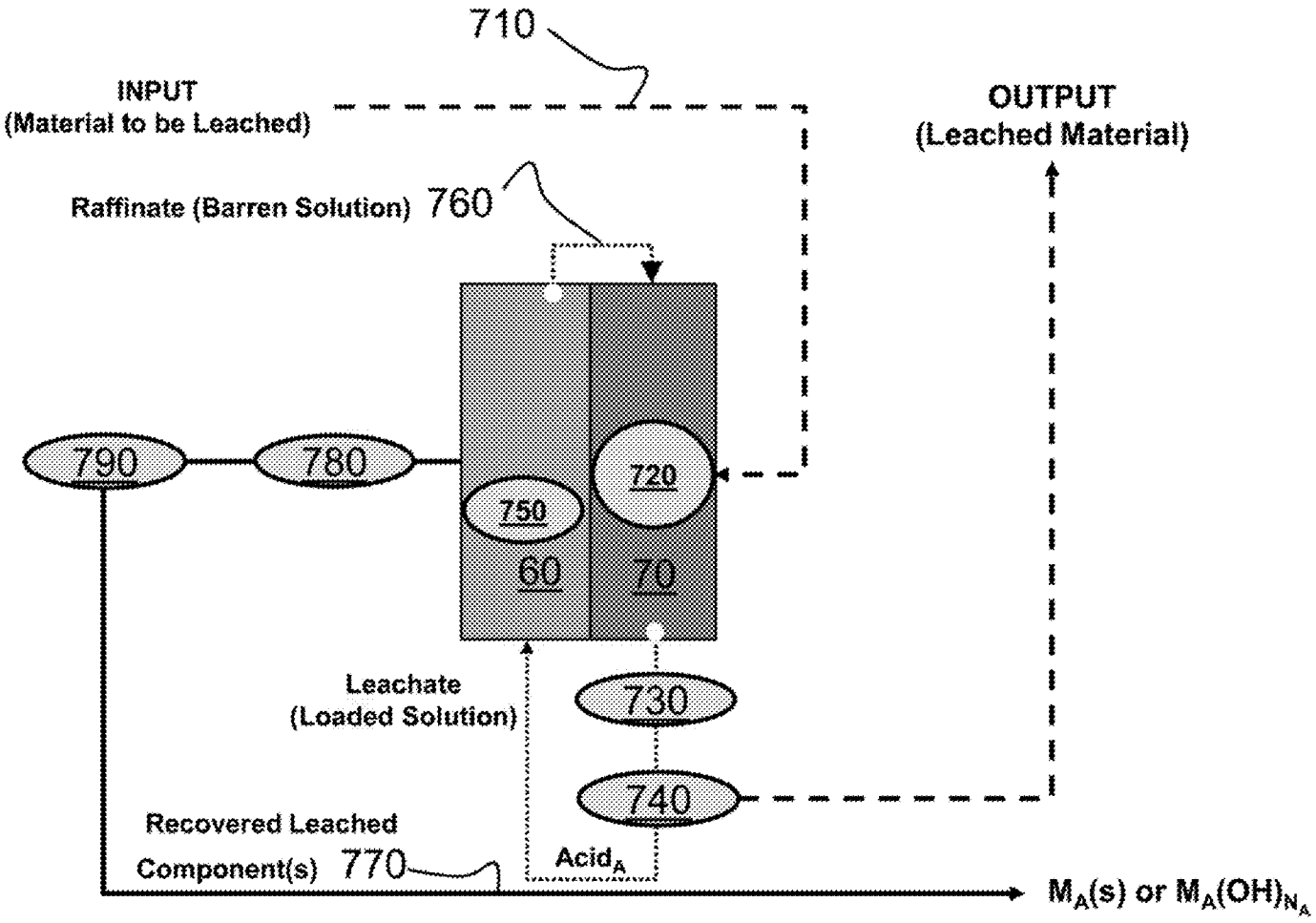
FIG. 7 is a schematic illustration of one embodiment of the current invention.

FIG. 7. schematically illustrates particulars of an example acid leaching process in accordance with one class of embodiments of the current invention. It should be noted that different embodiments may utilize essentially reversed process (relative to the illustration in FIG. 7) for alkaline leaching, when desirable. In FIG. 7, the leach solution 710 is passed to the at least one anode cell chamber 70 arranged to generate acid and combined with material to be leached (either in-situ, for example in at least one dedicated volume 720 or externally, for example in at least one separated reactor 730). Subsequently (after the leaching has been effected) the spent leached material may be separated from the anolyte, for example by at least one separator 740. The pregnant (leached component laden) anolyte 14 may be passed to at least one cathode cell chamber 60 for leached material recovery. Leached material could be directly plated (electrowon) or precipitated via electrochemical pH adjustment or other electrochemical manipulations (e.g. internally in at least one mixing volume 750 or externally in at least one separated reactor 780) and separated by at least one separator 790. The barren raffinate 760 (leach solution from which the majority of the leached component was removed), may be subsequently returned to the at least one anode cell chamber 70 where the acid and material to be leached may be replenished for another circuit through the system. The leached component 770 (to be recovered) may also be recovered ex-situ by non electrochemical means and, depending upon particular embodiments, by any of the number of embodiment-specific recovery methods.

The present invention has been described with references to the exemplary embodiments arranged for different applications. While specific values, relationships, materials and components have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

I claim:

1. A method for extraction of target components from raw liquid streams using electrochemical cells by manipulation of solvability, concentrations, and oxidation states of constituents of liquid streams by electro-effecting controllable changes of electrolytes pH values, comprising following steps:

a) provide at least one electrochemical cell arranged to support redox reactions resulting in electrochemical change of oxidation states and concentration of at least one target component, and to control at least one pH value of at least one electrolyte in the at least one electrochemical cell;

b) introduce at least one raw liquid stream comprising a combination of constituent ionic species into the at least one electrochemical cell;

c) operate the at least one electrochemical cell to change concentrations of at least two oxidation states of at least one targeted ionic species from the constituent ionic species, and to controllably change the pH value of the at least one electrolyte in the at least one electrochemical cell;

d) operate the at least one electrochemical cell to maintain a predetermined range of pH of the at least one electrolyte and to aggregate at least a portion of at least one target component pertinent to the at least one oxidation state of the targeted ionic species;

e) separate and extract at least aggregated portion of the at least one target component pertinent to the at least one oxidation state of the targeted ionic species;

f) separate and extract at least a part of reacted products from the at least one electrolyte in the at least one electrochemical cell.

2. The method for extraction of target components from raw liquid streams of claim 1; wherein the at least one electrochemical cell is a Moving Bed Electrode (MBE) electrochemical cell.

3. The method for extraction of target components from raw liquid streams of claim 2; wherein the Moving Bed Electrode (MBE) electrochemical cell is a Spouted Bed Electrode (SBE) electrochemical cell.

4. The method for extraction of target components from raw liquid streams of claim 1; wherein the oxidation states of ionized compound have been chosen from the set of ionization states consisting of Aluminum $Al^{+3}$, Cobalt $Co^{+2}$, Cobalt $Co^{+3}$, Cuprous $Cu^{+1}$, Cupric $Cu^{+2}$, Ferrous $Fe^{+2}$, Ferric $Fe^{+3}$, Magnesium $Mg^{+2}$, Manganese $Mn^{+2}$, Nickel $Ni^{+2}$, Nickel $Ni^{+3}$, Zinc $Zn^{+}$, and Zinc $Zn^{+2}$.

5. The method for extraction of target components from raw liquid streams of claim 1; wherein the at least one compound pertinent to the at least one oxidation state of the targeted ionic species is in the form of metal (Mx) hydroxide ($Mx_i(OH)_j$) and analogous compounds.

6. The method for extraction of target components from raw liquid streams of claim 1; wherein the at least one raw liquid stream includes at least one raw Acid Rock Drainage (ARD), acid leachate, or alkaline leachate.

7. A method for extraction of target components from raw liquid streams using electrochemical cells by manipulation of solvability, concentrations, and oxidation states of constituents of liquid streams by electro-effecting controllable changes of electrolytes pH values, comprising following steps:

a) provide at least one first electrochemical cell arranged to support redox reactions resulting in electrochemical change of oxidation states and concentration of at least one target component, and at least one second electrochemical cell arranged to control change the pH value of the at least one electrolyte in the at least one first electrochemical cell and the at least one second electrochemical cell;

b) introduce at least one raw liquid stream comprising a combination of constituent ionic species into the at least one first electrochemical cell;

c) operate the at least one first electrochemical cell to change concentrations of at least two oxidation states of at least one targeted ionic species from the constituent ionic species;

d) operate the at least one second electrochemical cell to maintain a predetermined range of pH values of the at least one electrolyte and to aggregate at least one target component pertinent to the at least one oxidation state of the at least one targeted ionic species;

e) separate and extract the at least one target component pertinent to the at least one oxidation state of the targeted ionic species;

f) separate and extract at least a part of reacted products from the at least one electrolyte in the at least one first electrochemical cell.

8. The method for extraction of target components from raw liquid streams of claim 7; wherein the at least one of first and second electrochemical cells is a Moving Bed Electrode (MBE) electrochemical cell.

9. The method for extraction of target components from raw liquid streams of claim 8; wherein the Moving Bed Electrode (MBE) electrochemical cell is a Spouted Bed Electrode (SBE) electrochemical cell.

10. The method for extraction of target components from raw liquid streams of claim 7; wherein the step e) of separation and extraction the at least one target component pertinent to the at least one oxidation state of the targeted ionic species is performed in at least one separate mixing tank arranged to aggregate at least one targeted component pertinent to the at least one oxidation state of the targeted ionic species under conditions of substantially stabile pH values achieved by introduction of at least one catholyte from the at least one second electrochemical cell.

11. The method for extraction of target components from raw liquid streams of claim 10; wherein the step e) of separation and extraction the at last one targeted component pertinent to the at least one oxidation state of the targeted ionic species is performed using at least one separate filtering unit.

12. The method for extraction of target components from raw liquid streams of claim 7; wherein the at least a part of neutralized products of step f) comprises strong inorganic acids.

13. The method for extraction of target components from raw liquid streams of claim 12; wherein the strong inorganic acids include sulfuric acid, hydrochloric acid, and mixtures of such acids.

14. The method for extraction of target components from raw liquid streams of claim 7; wherein the oxidation states of ionized target component have been chosen from the set of ionization states consisting of Aluminum $Al^{+3}$, Cobalt $Co^{+2}$, Cobalt $Co^{+3}$, Cuprous $Cu^{+1}$, Cupric $Cu^{+2}$, Ferrous $Fe^{+2}$, Ferric $Fe^{+3}$, Magnesium $Mg^{+2}$, Manganese $Mn^{+2}$, Nickel $Ni^{+2}$, Nickel $Ni^{+3}$, Zinc $Zn^{+}$, and Zinc $Zn^{+2}$.

15. The method for extraction of target components from raw liquid streams of claim 7; wherein the at least one compound pertinent to the at least one oxidation state of the targeted ionic species is in the form of metal (Mx) hydroxide ($Mx_i(OH)_j$) and analogous compounds.

16. The method for extraction of target components from raw liquid streams of claim 7; wherein the at least one raw liquid stream includes at least one raw Acid Rock Drainage (ARD), acid leachate, or alkaline leachate.

* * * * *